United States Patent [19]

Ramoni et al.

[11] 4,262,732

[45] Apr. 21, 1981

[54] APPARATUS AND PROCESS RELATING TO MANUFACTURING OF A FILAMENT DIRECTLY FROM A MOLTEN MATERIAL

[75] Inventors: Pierre Ramoni, Hauterive; Luc Espic; Wilfried Kurz, both of Lausanne, all of Switzerland

[73] Assignee: Nivarox S. A., Switzerland

[21] Appl. No.: 58,204

[22] Filed: Jul. 17, 1979

[30] Foreign Application Priority Data

Jul. 20, 1978 [CH] Switzerland ..... 7821/78

[51] Int. Cl.[3] ..... B22D 11/06; B22D 11/16

[52] U.S. Cl. ..... 164/87; 164/423; 164/429; 264/215; 264/212

[58] Field of Search ..... 164/87, 82, 423, 427, 164/429; 264/164, 165, 215, 212; 425/471, 224

[56] References Cited

U.S. PATENT DOCUMENTS

| | | | |
|---|---|---|---|
| 745,786 | 12/1903 | Cole | 164/423 |
| 993,904 | 5/1911 | Strange | 164/423 |
| 3,812,901 | 5/1974 | Stewart et al. | 164/87 |
| 3,862,658 | 1/1975 | Bedell | 164/87 |
| 3,863,700 | 2/1975 | Bedell et al. | 164/87 |
| 4,170,257 | 10/1979 | Pond et al. | 164/87 |

FOREIGN PATENT DOCUMENTS 555199 10/1974 Switzerland .

OTHER PUBLICATIONS

Maringer, Robert E., et al., "Casting of Metallic Filament and Fiber", *J. Vac. Sci. Technol.*, vol. 11, No. 6, 11/1974, pp. 1067–1071.

Reininger, Hans. *Gespritzte Metallueberzuege*, Carl Hauser Verlag, Munich, 1952, p. 14.

*Primary Examiner*—Robert D. Baldwin

*Assistant Examiner*—Gus T. Hampilos

*Attorney, Agent, or Firm*—Peter L. Berger; Sheldon Palmer

[57] ABSTRACT

The invention relates to an improvement of a manufacturing process for making a filament directly from a molten material. The process consists of the ejection of a liquid filament which solidifies in air by making a rotating disc touch the surface of a liquid. The improvement consists in the stabilization of the meniscus which appears upon the wheel near the surface of the liquid and thereby fixing the point where the filament leaves the wheel in order to obtain a constant cross section of the filament. The meniscus is stabilized by the interposition of a body: a rod or a convex piece of a material which does not react with the melt.

10 Claims, 2 Drawing Figures

APPARATUS AND PROCESS RELATING TO MANUFACTURING OF A FILAMENT DIRECTLY FROM A MOLTEN MATERIAL

The present invention relates to an improvement in a process for the manufacturing a filament from a molten material and in apparatus therefor.

The manufacturing process relates mainly to the production of metallic filaments, but not exclusively so.

Processes for making filaments directly from a melt in a crucible were described in U.S. Pat. No. 745,786 of December 1903 and U.S. Pat. No. 993,904 of May 30, 1911, for example. The first of the patents describes a method where a molten metal runs through a pipe at the bottom of a crucible with controlled efflux and arrives upon the surface of a vertical wheel which rotates around its fixed axis. The filament forms itself by the solidification in air of the liquid jet ejected by the wheel. The second U.S. Pat. No. 993,904 describes an improvement of the process by showing intermediate means between the wheel and the crucible allowing the stabilization of the efflux fo the molten metal.

Hans Reininger describes on page 14 of his book *Gespritzte Metall ueberzuege* (Sprayed or molded metal coatings)—Carl Hauser Verlag-Munich 1952—a process in which a disc provided with radial needles along its whole circumference is rotated at the surface of a metallic melt and thereby extracts from the metal filament-ends.

The improvement of the present invention applies particularly to a manufacturing process for a filament as well, which requires a rotating wheel impinging on the surface of a melt. The surface of the wheel generally has a V-shaped profile. When the crown of the disc dips into the melt, it entrains a certain quantity of liquid which solidifies in the shape of a filament, and is ejected by centrifugal force. This process dispenses with the use of an aperture for the controlled efflux of the molten material, which is, for example described in Patent CH No. 555,199.

This manufacturing process for making filament from a molten material has the disadvantage of being very sensitive to various parameters, mainly for the production of an uninterrupted and regular filament at high speeds. The important parameters which one has to consider are, (not in a priority order): the temperature of the melt, the temperature of the disc, the rotating speed of the wheel, the depth of penetration of the disc in the melt, ambient temperature, contamination of the wheel, surface contaminations of the melt, perturbations of the surface of the melt, traction forces acting upon the filament due to the winding mechanism, and shape and size of the wheel. In order to obtain a filament of a cross-section as constant as possible, the formation of surface oxides and dross and also the constoncy of all these parameters have to be closely controlled. Under constant working conditions, the filament lifts itself always at approximately the same spot from the disc. All perturbations translate themselves usually into an irregular loosening of the filament from the periphery of the disc.

Nevertheless, production of an even filament by imposing a point of take-off for the filament has been attempted. Thus, various methods were proposed in order to fix this point. They may be used separately or in unison.

First, such a method is used when the filament is produced within a controlled atmosphere. The filament leaves the enclosure through an aperture which produces a sucking effort upon it due to the Venturi effect. This constant tension exerted upon the filament stabilizes the take-off point.

Another means, described in U.S. Pat. No. 3,862,658 presses the filament against the disc on a defined part of its circumference by a gas jet. The take-off point is thus maintained at a higher level. Furthermore, this process allows also for faster cooling of the filament.

A third method, described in U.S. Pat. No. 3,812,901 forces the take-off by placing a filament guide connected with the winding system at the correct spot.

Despite the use of one or several of these methods and apparatus, displacements of the take-off point are always possible, indeed at lower amplitudes but at higher frequencies. The to- and -fro motion of the take-off point always forces an upper limit of the rotary speed of the wheel. Furtheremore, the realization of these means is sometimes time consuming or even impossible for some alloys.

Even without taking in account these inconveniences, the above means do not ensure a regular filament. Neither these methods nor any other prior art methods enable a filament to be produced with a constant diameter. Perturbations of one or the other parameters influence the regularity of the manufactured filament.

An object of the present invention is to provide a process and apparatus which produces a constant filament at greatly increased speeds despite deviations of the above parameters from their predetermined values. It is characterized by assuring the production of regular filament by stabilizing the meniscus which forms between the rotating disc and the surface of the melt by placing a body such as a rod or the like in contact with the meniscus.

Practically, the irregularity of the filament produced is caused by the instability of the meniscus which precedes it. By stabilizing the meniscus, the perturbations which act upon the produced filament are eliminated or, at least, lowered, whether the perturbations are caused by a surface wave of the melt, or by reaction layers upon the surface of the melt, or the like.

The advantages of the invention are, as shown in the following descriptions of the embodiments, extreme simplicity and resolution of the problem of the instability of the take-off point by resolving the basic cause. The eradication of the instability allows an increase of rotary speed of a noticeable amount. A finer filament can also be produced.

Figure 1:
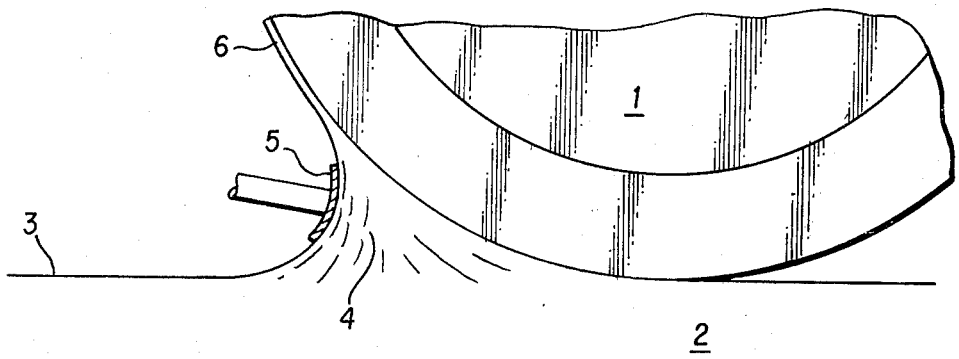
FIG. 1 is a schematical view of one embodiment of the invention.
Figure 2:
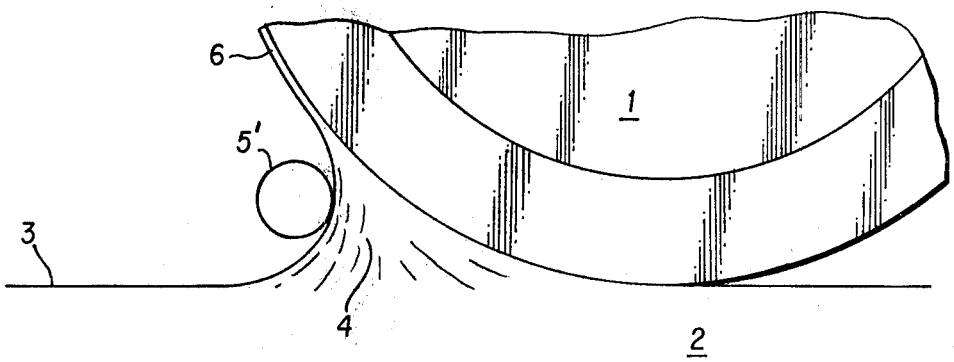
FIG. 2 is a schematical view of another embodiment of the invention.

Referring to FIG. 1, a disc 1 rotating around a fixed axis is shown. A melt or bath 2, a surface of the liquid 3 and the meniscus 4 are also shown. The means chosen as an example to stabilize the meniscus is a body 5 with a convex surface, which approximates the curve of the meniscus of the molten material 2, at least in the plane of the wheel or disc 1. This body consists of a material which is non-reactive with the melt, which for instance, may be made of a ceramic. Thus, the meniscus is not perturbed when, for instance, waves appear at the surface of the melt of impurites interrupt the surface. The disturbance is not transferred forward and the take-off point remains constant. The filament 6 produced by this method exhibits greatly improved cross-section and shape.

Instead of placing the convex-shaped body 5 shown, an alternative embodiment includes placing a simple shaped rod 5' in contact with the meniscus, said rod being parallel to the axis of the wheel.

In operation, as shown in the figures, the surface of the crown of the disc 1 entrains a quantity of molten material from bath or melt 2 and ejects it upwardly off the disc by centrifigal force. The body 5 is so located with respect to the disc 1 to assure the take-off point for the filament 6 from the disc 1 and to stabilize the meniscus 4 by being placed against it to eliminate perturbations.

The improvement of the fabrication process for filaments emerging from a melt according to this invention does not exclude its use with other improved methods. In fact, the invention may be applied, for example, together with a process for the permanent cleaning of the disc in order to prevent the appearance of impurities, as described in the Journal of Vacuum Science and Technology Vol. 11, November/December 1974, p. 1067.

What is claimed is:

1. An improvement of the process for fabricating a filament which emerges directly from a molten material, wherein the molten material is provided as a molten material bath and a disc having a crown surface is partially submerged in said molten material, said disc rotating around a fixed axis and entraining a quantity of the material in the crown of the surface of the disc and ejecting said quantity by centrifugal force, said quantity including a meniscus portion formed between the crown of the surface of the rotating disc and the surface of the melt, wherein the improvement comprises placing a body in contact with the meniscus between to stabilize the meniscus and assure the location of a take-off of the filament from the disc.

2. An improvement according to claim 1, wherein said rotating disc forms a plane of rotation and said body has a shape approximating the shape of the meniscus at least in said plane.

3. An improvement according to claim 1, further comprising the step of placing said body to contact the meniscus, wherein said body is a rod parallel to the axis of the disc.

4. An improvement according to claims 2 or 3, wherein the surface of the body contacting said meniscus is made of a material non-reactive with the melt.

5. An improvement according to claim 4, wherein said non-reactive material forming the surface of said body comprises a ceramic material.

6. A device for forming a filament directly from a fused material contained in a melt, said device comprising a rotating disc disposed generally vertically, said disc comprising a crown surface being disposed to be in contact with the melt, and being partially submerged therein, said rotating wheel forming a meniscus from the surface of the melt, and a fixed body disposed to be in contact with said meniscus, said fixed body stabilizing the meniscus and the location of a take-off point of the filament from the disc.

7. A device according to claim 6, wherein the surface of said body which touches the meniscus comprises a material which is non-reactive with said melt.

8. A device according to claim 7, wherein said non-reactive material forming the surface of said body comprises a ceramic material.

9. A device according to claim 6, wherein said rotating disc comprises a plane of rotation and the fixed body comprises a shape approximating the shape of the meniscus in the plane of the disc.

10. A device according to claim 6, wherein said disc rotates around an axis and the fixed body is a rod located essentially parallel to the axis of the disc.

* * * * *